US006494362B1

(12) United States Patent
Harmon

(10) Patent No.: US 6,494,362 B1
(45) Date of Patent: Dec. 17, 2002

(54) ID LABELED FABRIC AND METHOD OF APPLYING AN ID LABEL TO FABRIC AT ITS POINT OF MANUFACTURE

(76) Inventor: Christopher M. Harmon, 301 W. Main, Elkin, NC (US) 28621

( * ) Notice: Subject to any disclaimer, the term of this patent is extended or adjusted under 35 U.S.C. 154(b) by 0 days.

(21) Appl. No.: 09/557,241

(22) Filed: Apr. 24, 2000

(51) Int. Cl.[7] ..... G06F 17/00

(52) U.S. Cl. ..... 235/375; 235/462.01; 235/380; 235/385; 235/487; 235/494; 139/383; 139/459

(58) Field of Search ..... 235/375, 380, 235/385, 462, 462.01, 487, 494

(56) References Cited

U.S. PATENT DOCUMENTS

| | | | | | |
|---|---|---|---|---|---|
| 3,849,849 | A | | 11/1974 | Gottlieb | |
| 4,092,204 | A | * | 5/1978 | Wesley | 156/481 |
| 4,146,061 | A | | 3/1979 | Gotoh | |
| 4,585,037 | A | * | 4/1986 | Kimbara | 139/1 E |
| 4,605,847 | A | * | 8/1986 | Schittko et al. | 235/454 |
| 4,749,137 | A | | 6/1988 | Seagrove | |
| 4,766,301 | A | * | 8/1988 | Evers | 235/487 |
| 4,920,653 | A | * | 5/1990 | Kussmaul | 33/18.1 |
| 4,984,341 | A | | 1/1991 | Hagewood et al. | |
| 5,001,331 | A | * | 3/1991 | Leestemaker | 235/375 |
| 5,246,040 | A | * | 9/1993 | Barwick et al. | 139/11 |
| 5,282,278 | A | * | 2/1994 | Miner | 2/181.4 |
| 5,583,489 | A | * | 12/1996 | Loemker et al. | 235/487 |
| 5,854,148 | A | | 12/1998 | Asada et al. | |
| 5,932,867 | A | * | 8/1999 | Speckhart et al. | 235/385 |
| 5,941,572 | A | * | 8/1999 | Gundjian et al. | 283/67 |
| 6,068,895 | A | * | 5/2000 | Kimura | 428/29 |
| 6,123,117 | A | * | 9/2000 | Borellini | 139/407 |
| 6,296,022 | B1 | * | 10/2001 | Lowe | 139/1 R |
| 6,328,078 | B1 | * | 12/2001 | Wildeman et al. | 101/481 |
| 6,381,482 | B1 | * | 4/2002 | Jayaraman et al. | 600/388 |

FOREIGN PATENT DOCUMENTS

| | | | | |
|---|---|---|---|---|
| DE | 004216286 | A1 | * | 12/1993 |
| JP | 363005487 | A | * | 1/1988 |

* cited by examiner

*Primary Examiner*—Karl D. Frech
*Assistant Examiner*—Daniel Walsh
(74) *Attorney, Agent, or Firm*—Adams, Schwartz & Evans, P.A.

(57) ABSTRACT

A fabric is formed of interlacing yarns, and is labeled for ready and accurate identification by a manufacturer. The fabric includes a label carrier yarn selected from at least one end of the interlacing yarns. A fabric identifying label is attached to the label carrier yarn prior to incorporation of the label carrier yarn into the fabric. The label encircles the label carrier yarn in closely spaced relation such that the label avoids interfering with subsequent formation of the fabric.

20 Claims, 5 Drawing Sheets

ID LABELED FABRIC AND METHOD OF APPLYING AN ID LABEL TO FABRIC AT ITS POINT OF MANUFACTURE

TECHNICAL FIELD AND BACKGROUND OF INVENTION

The present invention relates to an ID labeled fabric, and method of applying an ID label to a fabric at its point of manufacture. The invention provides ready and accurate identification of fabric by permanently attaching an ID label to an end of continuous-filament or staple yarn prior to incorporating the yarn into the fabric. The ID label remains attached to the fabric during subsequent fabric processing and finishing operations. The invention is applicable to woven, nonwoven, and warp or circular-knitted fabrics.

The current industry practice for identifying fabrics, such as furniture upholstery, automotive textiles, carpet, and apparel is to label the finished product in its rolled or flat-folded state, or immediately after the initial manufacturing process. The ID label, commonly referred to as a "piece ticket" or "piece number" or "shop order", typically includes alphanumeric indicia and bar code data suitable for linking fabric specification requirements and the manufactured product. The ID label serves to identify the fabric, and is generally attached to the fabric using a self-adhesive sticker, pins, or staples. After manufacture and labeling, the fabric is passed through a series of fabric processing operations. Prior to each operation, the ID label is physically removed by a worker and hand carried to the end of the operation. Alternatively, the worker simply leaves the ID label attached to the fabric in hopes of it remaining attached throughout processing. During this process, however, many ID labels are either misplaced or lost, destroyed, or cut off or rubbed off the fabric. When an ID label is inadvertently removed, the pattern and color of the fabric must be identified and verified to or during final inspection. Because of the many different SKU's in the textile industry, accurate identification of unlabeled rolled and flat-folded fabric can be a tedious and complex undertaking. Periodic fabric inventories resulting in labor inefficiencies and manufacturer downtime are generally required in order to reconcile misidentified and unidentified fabric.

The present invention addresses these problems by providing accurate and permanent means of identifying fabric. Because the fabric is permanently labeled at its point of manufacture, the invention eliminates the occurrence of human error associated with the use of removable stickers, pins, and staples.

Unlike the process described in U.S. Pat. No. 4,766,301 to Evers, fabric labeling according to the present invention is an integral part of the manufacturing process. The '301 patent describes a bar code label which is itselfmade of a textile fabric. After the fabric label is made, it is then separately attached to an object using an adhesive. Using this label to identify fabric provides no more of a solution to the above problem than the current industry approach of adhering, pinning, or stapling ID labels to fabric. The present invention is not related to manufacturing a bar code out of fabric, but instead relates to the permanent attachment of ID labels to fabric at the point of manufacture.

SUMMARY OF THE INVENTION

Therefore, it is an object of the invention to provide a fabric which can be readily and accurately identified at the point of manufacture, and subsequently throughout further fabric processing and finishing operations.

It is another object of the invention to provide a fabric which includes a permanently attached ID label which does not interfere with fabric manufacture, or subsequent fabric and finishing operations.

It is another object of the invention to provide a fabric which includes a permanently attached ID label with permanent fabric identifying indicia that will not rub off or fade.

It is another object of the invention to provide a fabric which includes a permanently attached ID label located in the selvage.

It is another object of the invention to provide a fabric which includes an ID label integrally formed with the yarns of the fabric during manufacture.

It is another object of the invention to provide a fabric which includes an ID label with machine-readable bar code printed on one or both outside surfaces of the label.

It is another object of the invention to provide a fabric which includes an ID label with machine-readable bar code printed on one side of the label and alphanumeric indicia printed on the opposite side of the label.

It is another object of the invention to provide a fabric which includes an ID label formed around a single end of yarn prior to incorporating the yarn in the fabric.

It is another object of the invention to provide a fabric which includes an ID label formed around a two or more ends of yarn prior to incorporating the yarn in the fabric.

It is another object of the invention to provide a method of readily and accurately identifying woven, nonwoven, and knit fabrics.

These and other objects of the present invention are achieved in the preferred embodiments disclosed below by providing a fabric formed of interlacing yarns, and labeled for ready and accurate identification by a manufacturer. The fabric includes a label carrier yarn comprising at least one end of the interlacing yarns. A fabric identifying label is attached the label carrier yarn prior to incorporation of the label carrier yarn into the fabric. The label encircles the label carrier yarn in closely spaced relation such that the label avoids interfering with subsequent formation of the fabric.

According to another preferred embodiment of the invention, the fabric identifying label has opposing outside surfaces with fabric identifying indicia located on at least one of the opposing outside surfaces.

According to yet another preferred embodiment of the invention, the fabric identifying indicia is a machine-readable bar code.

According to yet another preferred embodiment of the invention, the fabric identifying indicia is an alphanumeric sequence.

According to yet another preferred embodiment of the invention, the fabric identifying indicia is located on each of the opposing outside surfaces of the label.

According to yet another preferred embodiment of the invention, the fabric identifying label is formed of a flexible thermoplastic polymer.

In another embodiment, a woven fabric is formed of interlacing filling and warp yarns, and is labeled for ready and accurate identification by a manufacturer. The fabric includes a label carrier yarn comprising at least one end of the warp yarn. A fabric identifying label is attached to the label carrier yarn prior to incorporation of the label carrier yarn into the fabric. The label encircles the label carrier yarn in closely spaced relation thereto to avoid interfering with subsequent formation of the woven fabric.

According to another preferred embodiment of the invention, the label carrier yarn is a single end of warp yarn. to yet another preferred embodiment of the invention, the label carrier yarn is two or more ends of warp yarn.

In another embodiment, the invention is a method of identifying woven fabric. The method includes the step of attaching a fabric identifying label to a label carrier yarn prior to weaving the label carrier yarn into the fabric.

According to another preferred embodiment of the invention, the method includes the step of applying a machine-readable bar code to the fabric identifying label.

According to yet another preferred embodiment of the invention, the method includes the step of applying a machine-readable bar code to one outside surface of the fabric identifying label and an alphanumeric sequence to the opposite outside surface of the fabric identifying label.

According to yet another preferred embodiment of the invention, the method includes the step of forming the fabric identifying label of a flexible thermoplastic polymer.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
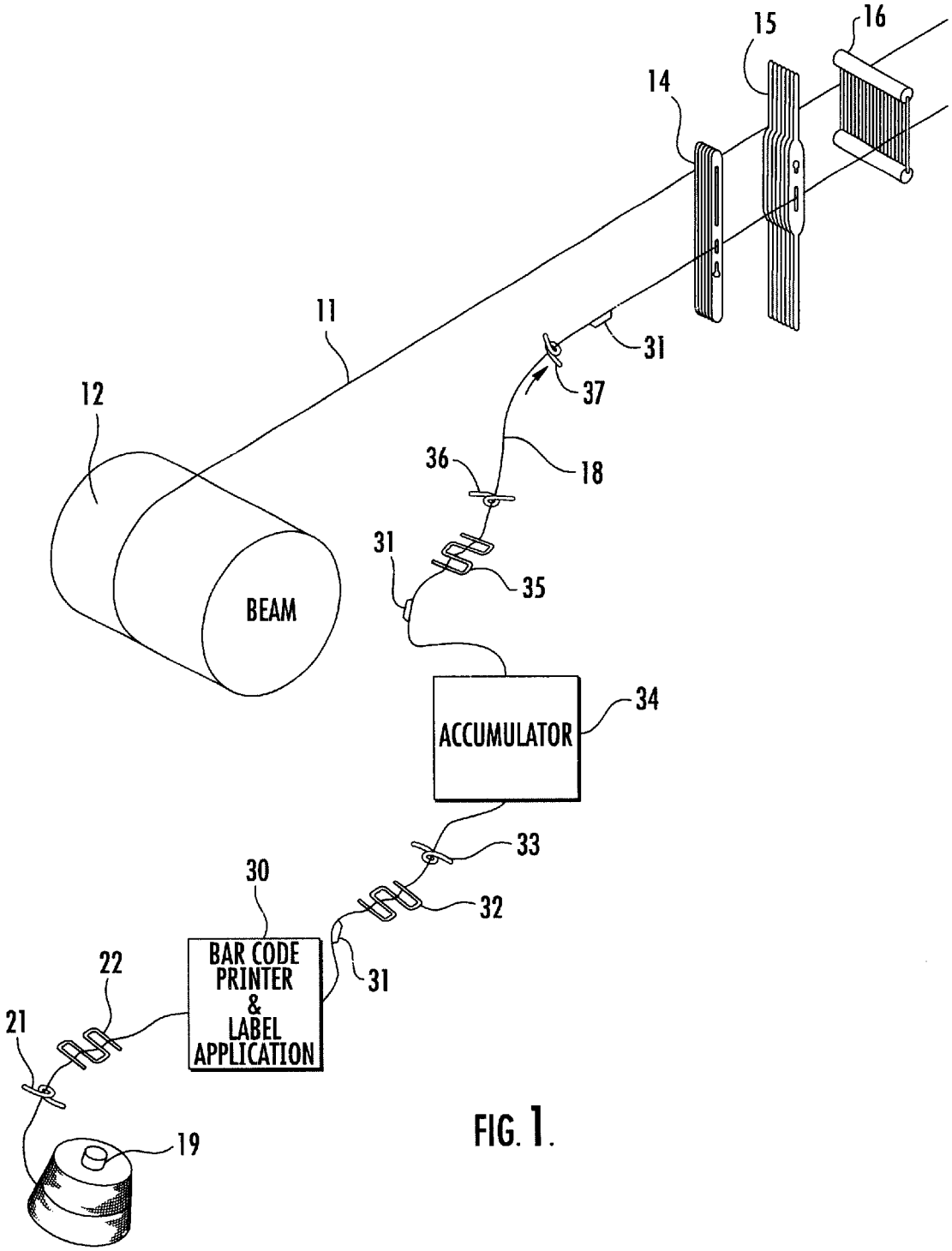
FIG. 1 is a schematic diagram illustrating a method according to one preferred embodiment of the invention for permanently labeling fabric at its point of manufacture.
Figure 2:
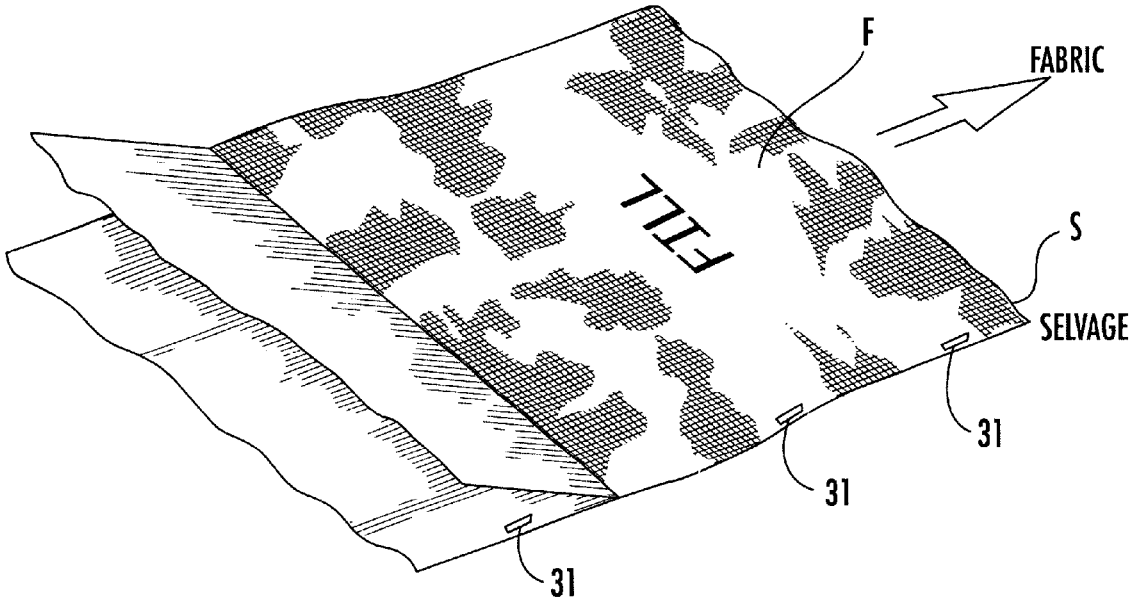
FIG. 2 is a fragmentary perspective view illustrating the formation of a length of woven fabric with a permanently attached ID label incorporated in the selvage.

Referring now specifically to the drawings, a schematic diagram illustrating a method according to the present invention for labeling fabric at its point of manufacture is shown in FIG. 1. The resulting labeled fabric "F", shown in FIG. 2, is readily and accurately identified during subsequent fabric processing and finishing operations. In one preferred embodiment, the fabric "F" is formed of interlacing ends of warp and filling yarn woven together in a conventional manner using conventional textile weaving machinery. In alternative embodiments, the fabric is formed of nonwoven and knit yarn.

For purposes of illustration, FIG. 1 shows a single end of warp yarn 11 carried on a warp beam 12 and fed through a drop wire assembly 14, heddle harness 15, and reed 16. The warp beam 12 actually carries hundreds of ends of warp yarn 11. A separate end of warp yarn 18 is arranged on a carrier 19 located near the warp beam 12. The yarn 18 passes from the carrier 19 through a yarn guide 21 and tensioning device 22, and into a bar code printer and label application assembly 30. The assembly 30 operates to permanently attach a fabric identifying label 31 to the yarn 18 prior to weaving the yarn 18 into the fabric "F". The ID label 31 is folded around the yarn 18 to define opposing outside surfaces each with printed indicia, such as machine-readable bar code, indicating the fabric type and specifications. The bar code printer and label application assembly 30 is described in further detail below.

From the assembly 30, the labeled yarn 18 passes downstream through a tensioning device 32 and yarn guide 33, and into an accumulator 34 where the labeled yarn 18 is collected for continuous, uninterrupted feeding to the loom (not shown). The accumulator 34 controls unwinding tension as the labeled yarn 18 passes to a third tensioning device 35 and through yarn guides 36 and 37 where it joins with yarn 11 from the warp beam 12. Detailed operation of accumulators suitable for use in the present invention is provided in prior art patents, such as U.S. Pat. Nos. 4,553,709; 4,749,137; and 4,984,341; the disclosures of which are incorporated herein by reference.

Figure 3:
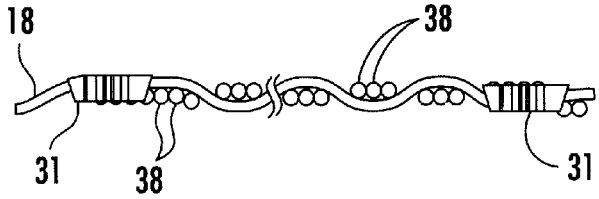
FIG. 3 is an enlarged, fragmentary, side edge view of the woven fabric showing the warp yarn and filling yarn.

The labeled yarn 18 is fed through the drop wire assembly 14, heddle harness 15, and reed 16, and is interlaced with filling yarn during weaving of the fabric "F". The filling yarn is inserted into the fabric "F" at the shed in a conventional manner, and is beaten into the fell by the reed 16. The labeled yarn 18 is woven into the fabric selvage "S", as shown in FIG. 2, such that the ID label 31 floats on the top and bottom of the filling yarn 38, as shown in FIG. 3. The ID label 31 is conveniently scanned during and after fabric processing and finishing operations using conventional bar code scanning equipment.

Figure 4:
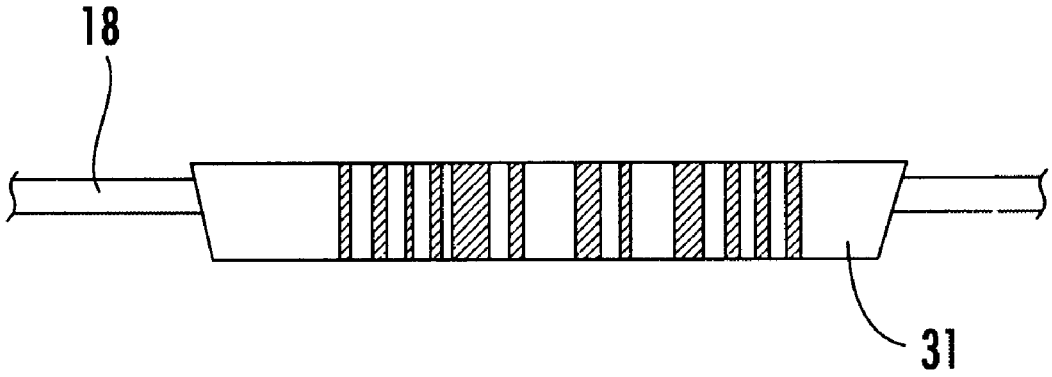
FIG. 4 is an enlarged, fragmentary view of the labeled warp yarn and ID label.
Figure 5:
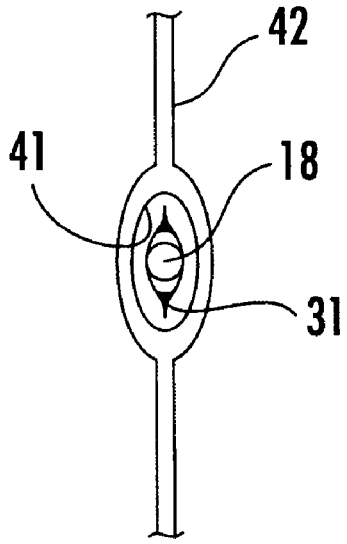
FIG. 5 is an enlarged end view of the labeled yarn and ID label passing through the eye of a heddle.

As shown FIG. 4, the length of the ID label 31 is preferably substantially greater than its height such that the labeled yarn 18 passes freely through the eyes of drop wire and heddle, and through the reed into the fabric "F". An end view of the labeled yarn 18 passing through the eye 41 of a heddle 42 is shown in FIG. 5. The ID label 31 does not interfere with any aspect of the weaving process, and remains permanently attached to the labeled yarn 18 throughout subsequent fabric processing and finishing. In one embodiment, the height of the ID label 31 after application to the yarn 18 is approximately 2 mm and the length approximately 8 mm. Preferably, the label 31 is made of a flexible thermoplastic material which is folded prior to placement onto the yarn 18, and subsequently heat sealed or crimped around the diameter of the yarn 18 during printing.

Printing and Applying the ID Label 31

While the fabric ID label 31 can be printed and applied to the yarn 18 in many different ways, one preferred means using the bar code printer and label application assembly 30 is shown in FIGS. 6–9. The assembly 30 includes first and second opposing printers 51A and 51B including respective printer posts 52A and 52B, feed rollers 53A and 53B, and take up rollers 54A and 54B interconnected by printer ribbons 55A and 55B. The printers 51A and 51B are mounted for inward and outward movement towards and away from the yarn 18. A label storage and transfer assembly 56 is located above the yarn 18, and includes cam-actuated transfer arms 58 and 59 which cooperate to collect and transfer individual labels 31 one at a downwardly from a label storage chute 61 onto the yarn 18. The label storage chute 61 has an open bottom and sides, and slightly inwardly-turned flanges (not shown) formed on front and back walls sufficient for releasably retaining the labels 31 inside the storage chute 61 prior to transfer. The transfer arms 58 and 59 include respective pairs of downwardly angled fingers 62 and 63 which enter the storage chute 61, capture a single label 31, and carry the label 31 downwardly onto the yarn 18.

The assembly 30 further includes optic or photoelectric sensors (not shown) located at an exit end of the assembly 30 for controlling the printing sequence. According to one embodiment, the sensors detect yarn movement and control print sequences at every 10 feet of yarn to allow application of the ID label 31, as described below.

Figure 6:
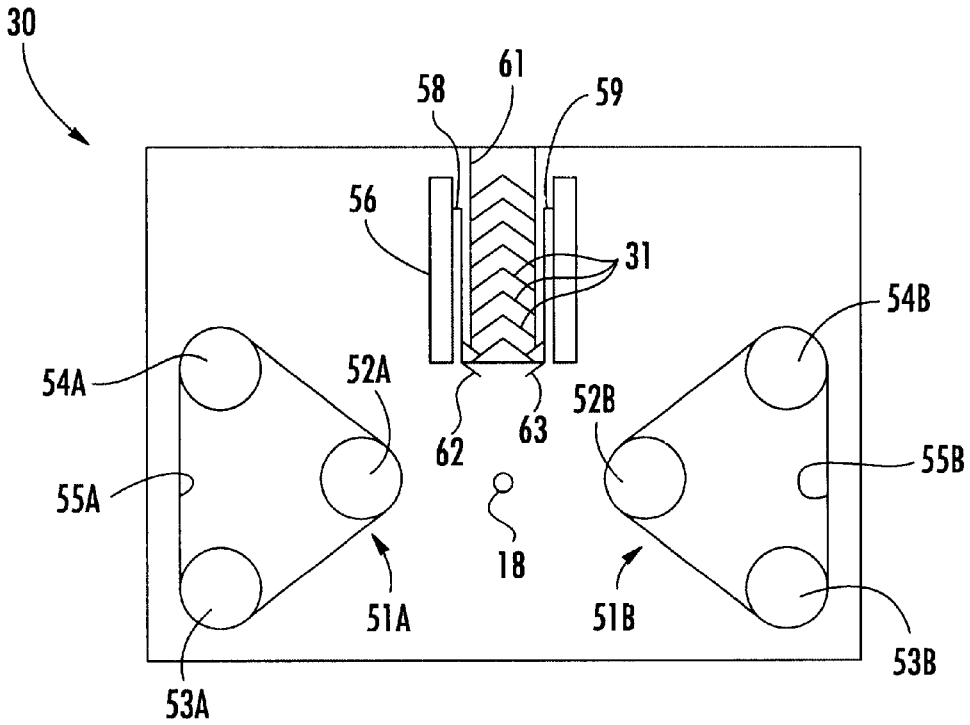
FIG. 6 is a view of the bar code printer and label application assembly with the transfer arms in the label-loading position prior to application of the ID label to the warp yarn.
Figure 7:
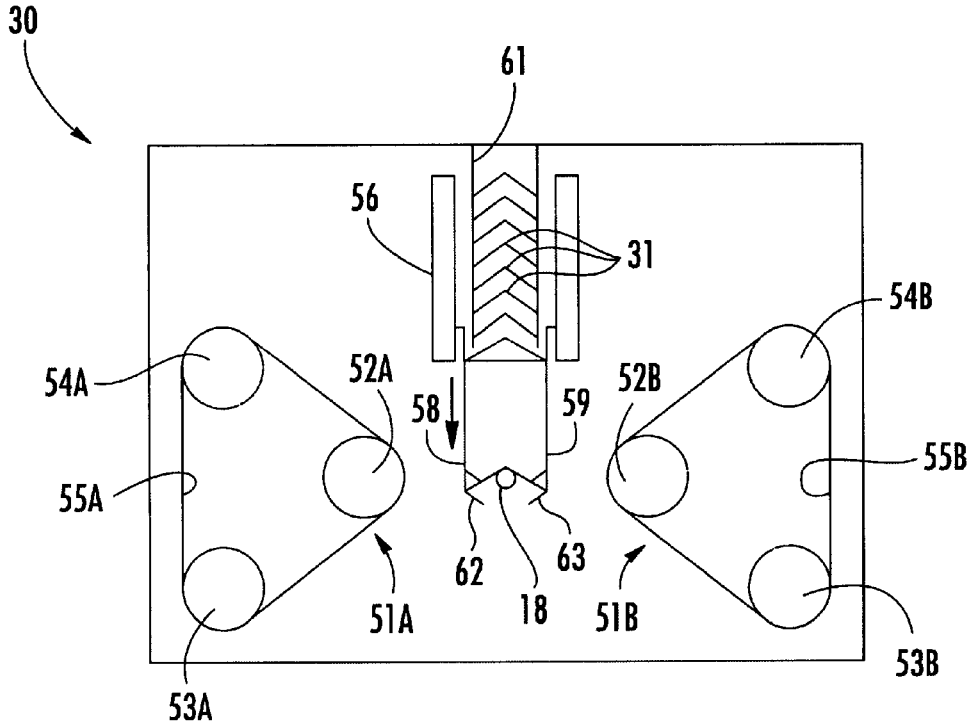
FIG. 7 is a view of the bar code printer and label application assembly showing the transfer arms carrying the ID label downwardly onto the warp yarn.
Figure 8:
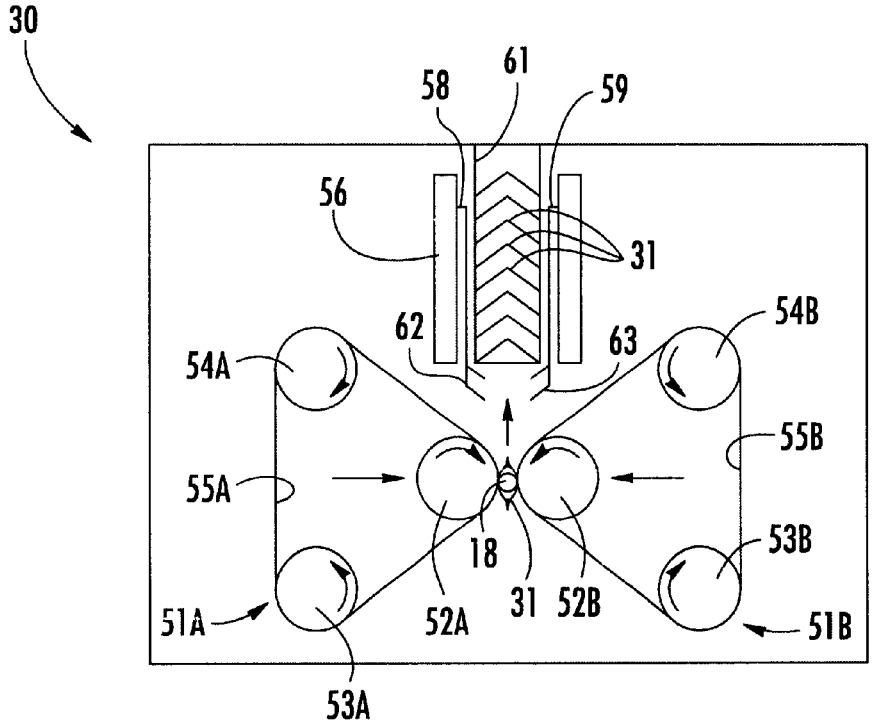
FIG. 8 is a view of the bar code printer and label application assembly showing the printers moved inwardly to the printing position with the printer posts applying the ID label to the warp yarn.
Figure 9:
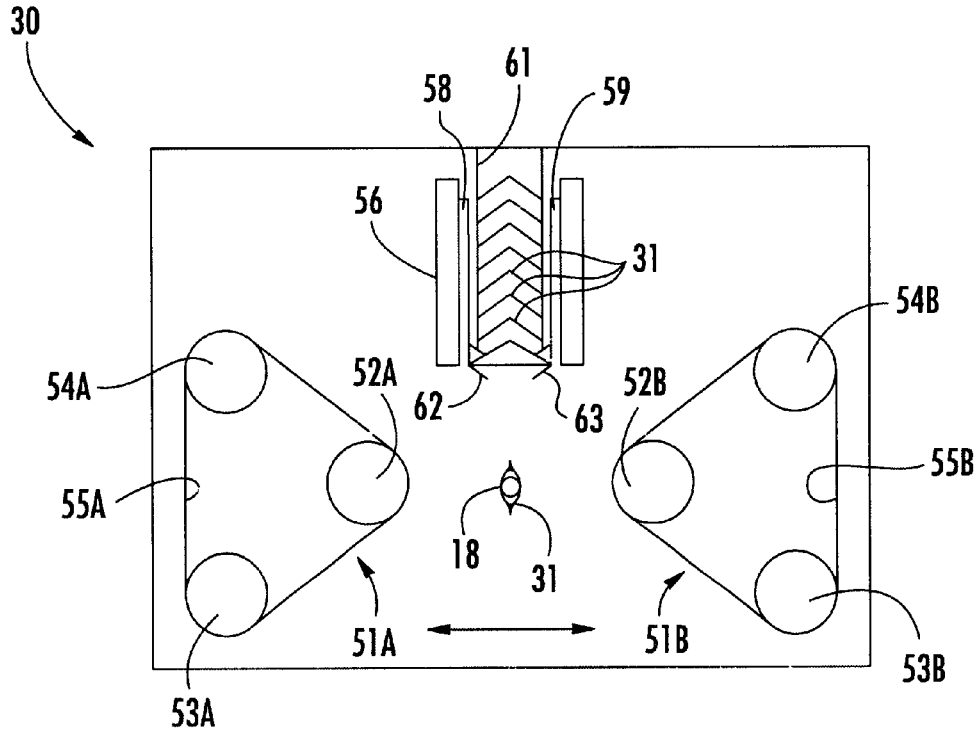
FIG. 9 is a view of the bar code printer and label application assembly showing the printers moved outwardly to their inoperative position with the transfer arms in the label-loading position for transferring a second ID label to the warp yarn.

As shown in FIGS. 6 and 7, a single ID label 31 is captured by the transfer arms 58 and 59 and carried downwardly for placement onto the yarn 18. After placement of the ID label 31 and return of the transfer arms 58 and 59 to their raised position, the printers 51A and 51B move inwardly, as shown in FIG. 8, such that the opposing printer posts 52A and 52B engage the ID label 31 forcing the label 31 together and printing indicia, such as machine-readable bar code and/or an alphanumeric sequence, on each of the opposing outer surfaces of the label 31. Preferably, the printing operation generates sufficient heat and pressure to permanently heat seal the label 31 around the yarn 18. As shown in FIG. 9, after printing, the printers 51A and 51B move outwardly away from the yarn 18 and the operation of the accumulator 34 resumes to continue downstream movement of the yarn 18. The transfer arms 58 and 59 re-enter the label storage chute 61 to collect another label 31 for subsequent transfer onto the yarn 18 at the predetermined interval. The ink or dye applied to the ID labels 31 is of withstanding high back-coating, textile dying and washing temperatures.

In an alternative embodiment, the ID labels 31 are preprinted using any suitable bar code printing device, such as described in U.S. Pat. Nos. 4,659,416 and 5,857,789, and are subsequently hand crimped or heat sealed onto single or multiple ends prior to incorporating the yarn into the fabric. In this embodiment, the labeled yarn is first collected on a carrier or bobbin and then fed directly through guides to the drop wire assembly, heddle harness, and reed, as described above. The labeled fabric is scanned using conventional bar code scanners such as described in U.S. Pat. Nos. 5,640,002 and 5,781,708. The disclosures of each of the above patents are incorporated herein by reference.

In yet another embodiment, the ID label is simply a color-coded tag affixed to single or multiple ends prior to weaving. The colored tag may be manually attached to the yarn by crimping, heat sealing, an adhesive, or any other suitable means.

According to another application of the invention, conventional bar code scanning equipment can be located at each downstream fabric processing and finishing station to automatically identify fabric type and specifications immediately prior to treatment. The invention substantially increases fabric manufacturing efficiency and virtually eliminates the possibility of human error.

An ID labeled fabric and method of applying a permanent ID label to a fabric at its point of manufacture are described above. Various details of the invention may be changed without departing from its scope. Furthermore, the foregoing description of the preferred embodiment of the invention and the best mode for practicing the invention are provided for the purpose of illustration only and not for the purpose of limitation—invention being defined by the claims.

I claim:

1. A fabric formed of interlacing yarns, and labeled for ready and accurate identification by a manufacturer, said fabric comprising:

(a) a label carrier yarn comprising at least one end of said interlacing yarns; and (b) a fabric identifying label attached to said label carrier yarn prior to incorporation of said label carrier yarn into said fabric, and encircling said label carrier yarn in closely spaced relation thereto such that said label avoids interfering with subsequent formation of said fabric.

2. A fabric according to claim 1, wherein said fabric identifying label has opposing outside surfaces with fabric identifying indicia located on at least one of said opposing outside surfaces.

3. A fabric according to claim 2, wherein said fabric identifying indicia comprises a machine-readable bar code.

4. A fabric according to claim 2, wherein said fabric identifying indicia comprises an alphanumeric sequence.

5. A fabric according to claim 2, wherein said fabric identifying indicia is located on each of the outside surfaces of said label.

6. A fabric according to claim 1, wherein said fabric identifying label is formed of a flexible thermoplastic polymer.

7. A woven fabric formed of interlacing warp and filling yarns, and labeled for ready and accurate identification by a manufacturer, said fabric comprising:

(a) a label carrier yarn comprising at least one end of said warp yarn; and (b) a fabric identifying label attached to said label carrier yarn prior to incorporation of said label carrier yarn into said fabric, and encircling said label carrier yarn in closely spaced relation thereto to avoid interfering with subsequent formation of said woven fabric.

8. A fabric according to claim 7, wherein said fabric identifying label has opposing outside surfaces with fabric identifying indicia located on at least one of said opposing outside surfaces.

9. A fabric according to claim 8, wherein said fabric identifying indicia comprises a machine-readable bar code.

10. A fabric according to claim 8, wherein said fabric identifying indicia comprises an alphanumeric sequence.

11. A fabric according to claim 8, wherein said fabric identifying indicia is located on each of the outside surfaces of said label.

12. A fabric according to claim 7, wherein said fabric identifying label is formed of a flexible thermoplastic polymer.

13. A fabric according to claim 7, wherein said label carrier yarn consists of a single end of warp yarn.

14. A fabric according to claim 7, wherein said label carrier yarn consists of multiple ends of warp yarn.

15. A method of identifying woven fabric comprising the step of attaching a fabric identifying label to a label carrier yarn prior to weaving the label carrier yarn into the fabric.

16. A method according to claim 15, wherein the label carrier yarn comprises a single end of warp yarn.

17. A method according to claim 15, wherein the label carrier consists of a single end of warp yarn.

18. A method according to claim 15, and comprising the step of applying a machine-readable bar code to the fabric identifying label.

19. A method according to claim 15, and comprising the step of applying a machine-readable bar code to one outside surface of the fabric identifying label and an alphanumeric sequence to an opposite outside surface of the fabric identifying label.

20. A method according to claim 15, and comprising the step of forming the fabric identifying label of a flexible thermoplastic polymer.

* * * * *